US006090517A

United States Patent [19]

Tamura et al.

[11] Patent Number: 6,090,517

[45] Date of Patent: Jul. 18, 2000

[54] TWO COMPONENT TYPE DEVELOPER FOR ELECTROSTATIC LATENT IMAGE

[75] Inventors: Kishio Tamura; Mayumi Hayashi; Masafumi Uchida; Yuji Marukawa; Kenji Yamane, all of Hachioji, Japan

[73] Assignee: Konica Corporation, Japan

[21] Appl. No.: 08/971,096

[22] Filed: Nov. 14, 1997

Related U.S. Application Data

[63] Continuation of application No. 08/586,958, Jan. 16, 1996, abandoned.

[30] Foreign Application Priority Data

Jan. 19, 1995 [JP] Japan ..... 7-006452
Jan. 31, 1995 [JP] Japan ..... 7-013986

[51] Int. Cl.[7] ..... G03G 9/107; G03G 9/113

[52] U.S. Cl. ..... 430/106.6; 430/108; 430/111

[58] Field of Search ..... 430/106.6, 108, 430/111, 137; 428/407

[56] References Cited

U.S. PATENT DOCUMENTS

| | | | |
|---|---|---|---|
| 4,125,667 | 11/1978 | Jones | 428/407 |
| 5,360,690 | 11/1994 | Nakano et al. | 430/110 |
| 5,391,451 | 2/1995 | Yoshie et al. | 430/106.6 |
| 5,466,552 | 11/1995 | Sato et al. | 430/106.6 |
| 5,795,693 | 8/1998 | Okado et al. | 430/106.6 |
| 5,798,198 | 8/1998 | Sukovich et al. | 430/106.6 |

FOREIGN PATENT DOCUMENTS

| | | | |
|---|---|---|---|
| 0441127 | 8/1991 | European Pat. Off. | 430/108 |
| 2-146061 | 6/1990 | Japan | 430/106.6 |
| 6-110253 | 4/1994 | Japan . | |

OTHER PUBLICATIONS

Patent & Trademark English–Language Translation of JP 6–110253 (Pub Apr. 1994).

Patent & Trademark Office English–Language Translation of JP 2–146061 (Pub Jun. 1990).

Derwent Abstract 90–214713/28 of JP 2–146061 (1990).

*Primary Examiner*—Janis L. Dote

*Attorney, Agent, or Firm*—Jordan B. Bierman; Bierman, Muserlian and Lucas

[57] ABSTRACT

Disclosed is a developer for developing an electrostatic latent image, comprising:

a carrier prepared by coating a magnetic particle with a resin by a surface polymerization coating method, the carrier having a sphericity $\alpha$ of 1.0 to 24.0, and a toner particle.

14 Claims, 6 Drawing Sheets

FIG. 2 ( a )
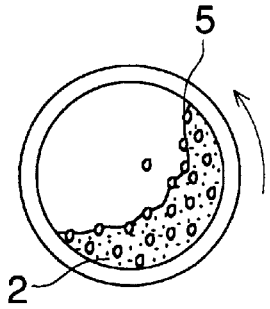
FIG. 2 ( b )
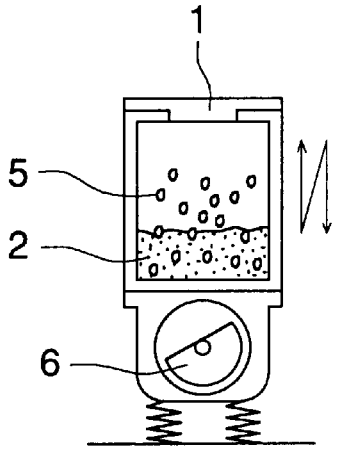
FIG. 2 ( c )
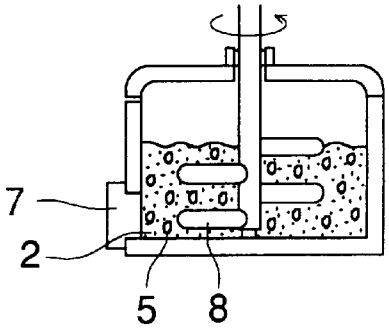

TWO COMPONENT TYPE DEVELOPER FOR ELECTROSTATIC LATENT IMAGE

This application is a continuation of application Ser. No. 08/586,958, filed Jan. 16, 1996, now abandoned.

FIELD OF THE INVENTION

The present invention relates to an electrostatic image developing carrier for use in an electrophotographic method, electrostatic photographing method, electrostatic printing method, or the like.

BACKGROUND OF THE INVENTION

Conventionally, carrier and toner are used for a two component developing method which is a representative developing method of the electrostatic image developing method. Now, a coating carrier, in which a magnetic particle is coated with resin, is commonly used as a practical carrier.

As resins used for coating, there are a large number of resins such as styrene/acrylic acid ester types, fluorine types, silicone types, and the like. Polyolefin type resins may also be used as one of these resins. Polyolefine type resins have the following advantages: water repellency is strong; a thick film can be applied with increared mechanical elasticity; stresses applied onto the carrier can be absorbed and decreased; and adherence onto toner is minimized.

For example, a carrier, in which magnetic particles are fusion-coated by a polypropylene resin, is disclosed in Japanese Patent Publication Open to Public Inspection No. 154639/1977. Further, a coated carrier in which magnetic particles are mechanically coated by a polytetrafluoroethylene resin, is disclosed in Japanese Patent Publication Open to Public Inspection No. 35735/1979. However, in these carriers, the adhesive property to the core magnetic particle is insufficient, so that unacceptable film peeling occurs and these carriers have insufficient durability for a long period of time, which is a major problem.

As a countermeasure to the problem, a coated carrier, coated by a surface polymerization coating method of polyolefine is disclosed in Japanese Patent Publication Open to Public Inspection No. 106808/1985, and further, another coated carrier, which is surface-polymerization-coated with a polyethylene resin, is disclosed in Japanese Patent Publication Open to Public Inspection No. 187770/1990. However, these carriers cause unevenness in catalyst carrying positions, so that nonuniform coating conditions occurs on the carrier surface. Therefore, lowered fluidity of the carrier, nonuniform charging amounts, toner-spent, and charge-up occur. Accordingly, although the carrier has the above-described advantages, it has a major practical problem which has not yet been overcome.

As a carrier for use in electrostatic image developers for electrophotography, or the like, a carrier, which is made such that polyolefine is polymerized onto the surface of magnet particles such as ferrite, or the like, and therewith the surface of the particle is covered, is proposed in Japanese Patent Publication Open to Public Inspection No. 187770/1990. In this proposal, although a good carrier is obtained in which a toner-spent or durability of carrier covered resin is greatly improved, there is a problem, in which magnetic particles are exposed on a portion of the carrier surface, or a possibility in which polymerization is unstable depending on surface metals of the magnetic particles. On such the exposed portions of magnetic particles, toner tends to be spent especially under conditions of high temperature and high humidity. When polymerization is unstable, adhesive strength between polyolefine and magnetic particles is weak, and therefore coating film peeling occurs, especially under low temperature and low humidity conditions. Further, the specific gravity of ferrite is not more than that of iron powder, but comparatively not so smaller, and therefore, there is a problem in which the charging property varies due to stress in the developing unit, which is still under investigation.

In order to decrease the specific weight of the carrier, a carrier is proposed in which polyolefine is polymerized onto the surface of a binder type core on which magnetic particles are dispersed, as disclosed in Japanese Patent Publication Open to Public Inspection No. 70853/1992. Although the binder type carrier has a lesser specific weight of 2.0 through 3.0, and is effective in decreasing stress in the developing unit, the surface of the binder type core is relatively smooth, and thereby, catalyst tends to be barely carried. Therefore, the cover due to polymerization of the polyolefine is not uniform, so that the adhesive strength between the core and cover resin is relatively weak, which is a problem.

An object of the present invention is to solve the above-described problems while inherent features of polyolefin resin, that is, strong repellency, relatively high mechanical strength due to large film thickness, stresses applied onto the carrier being absorbed or lightened, and further, toner fusion-adherence rarely occurring, etc., are being maintained.

The present invention is made under the above-described conditions, and an object of the present invention is to provide a carrier for use in an electrostatic image developer in which no toner-spent or non-film peeling occur even under a long period of use, and the charging property does not vary, so that high image quality can be constantly maintained.

Therefore, an object of the present invention is to provide a carrier by which an outputted image, with maximum image density and high resolution, can be stably maintained over an extended period of time.

SUMMARY OF THE INVENTION

The objects of the present invention are attained by the following embodiments.

(1) An electrostatic image developing carrier in which a polyolefin resin coated layer is formed on the surface of the magnetic particle by a surface polymerization coating method, wherein the sphericity $\alpha$ of the carrier is 1.0 through 16.0.

Specifically, after coating the polymer onto the surface of the magnetic particle, mechanical and mechanical/thermal stress is applied onto the carrier surface, so that concave and convex areas on the carrier surface are eliminated (it is referred to as surface smoothing, hereinafter). By this method of the present invention, the fluidity of the carrier is improved and more stable conveying amount of the developer is attained.

In order to set the sphericity ratio of the carrier and the core within an appropriate range, initially the sphericity of the core magnetic particle is found, and a method can be used in which, after the polymer coating onto the surface of the magnetic particle, mechanical and mechanical/thermal stress is applied onto the carrier surface, so that concave and convex areas on the carrier surface are eliminated. In this case, spread of the charged amount distribution due to nonuniform coated layer thickness can be prevented by controlling the degree of smoothness in view of the shape of the core.

The above-described object of the present invention is attained by the following carrier and developer: $Fe_2O_3$; a carrier having a polyolefine coating layer formed by a surface polymerization coating method on the magnetic particles, including an oxide of any of the following elements {Li, Be, Na, Mg, K, Ca, Rb}; and an electrostatic image developer including the carrier and toner containing a coloring agent and resin. It is preferable that the toner particles have a volume average particle size of 1 to 20 $\mu$m, more preferably 4 to 15 $\mu$m.

BRIEF DESCRIPTION OF THE DRAWINGS

FIGS. 2(*a*), 2(*b*) and 2(*c*) are sectional views showing a concept of a smoothing processing device, according to the present invention, in which carrier and mixture medium are supplied, and thereby mechanical stress is applied onto the carrier particles.

EXPLANATION OF NUMERICAL CODES

Figure 1:
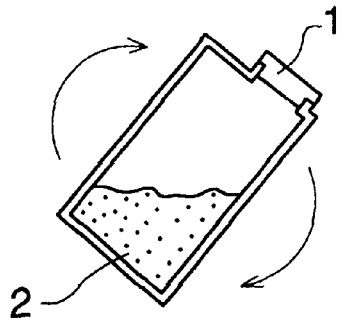
FIGS. 1(*a*), 1(*b*) and 1(*c*) are sectional views showing a concept of a smoothing processing device, according to the present invention, in which the mixing container itself is rotated and thereby mechanical stress is applied onto the carrier particles.
Figure 1:
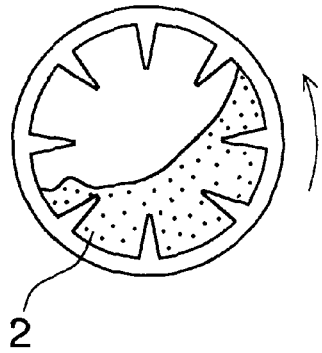
Figure 1:
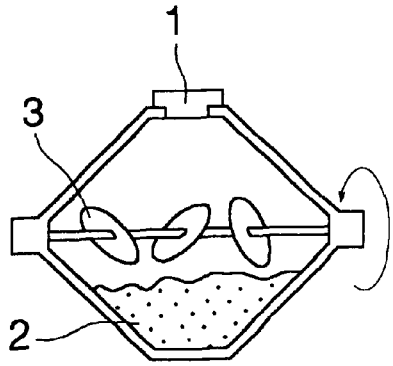

1. Sample supply opening
2. Carrier
3. Baffle plate
5. Mixture medium
6. Unbalanced weight
7. Sample outlet
8. Mixing rod
11. Mixing blade
15. Screen
16. Air flow
17. Hopper
18. Collision plate

DETAILED DESCRIPTION OF THE INVENTION

As a method by which the mechanical stress is applied onto the carrier surface, the following methods are listed as representative ones. Specific examples of smoothing processing devices are shown in FIGS. 1 through 6.

[1] FIG. 1 shows a method in which a mixing container, in which the carrier is supplied, is itself rotated and thereby mechanical stress is applied to the carrier. In FIG. 1, numeral 1 is a sample supply opening, numeral 2 is the carrier, and numeral 3 is a baffle plate.

[2] FIG. 2 shows a method in which the carrier and mixing medium are supplied into the device, and mechanical stress is applied to the carrier utilizing the movement of the mixing medium. In FIG. 2, numeral 5 is a mixing medium, numeral 6 is an unbalanced weight, numeral 7 is a sample outlet, and numeral 8 are stirring rods.

Figure 3:
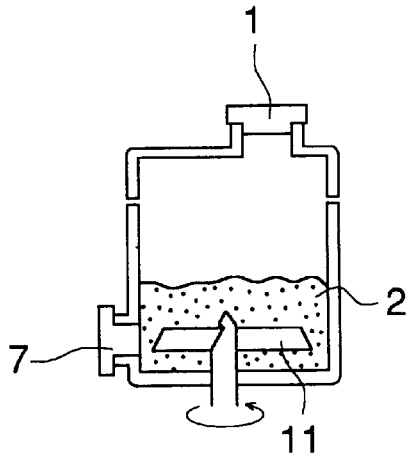
FIGS. 3(*a*), 3(*b*) and 3(*c*) are sectional views showing a concept of a smoothing processing device, according to the present invention, in which stirring blades are rotated, and thereby mechanical stress is applied onto the carrier particles.
Figure 3:
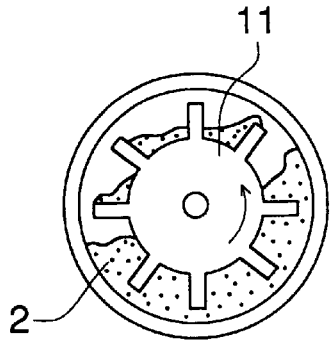
Figure 3:
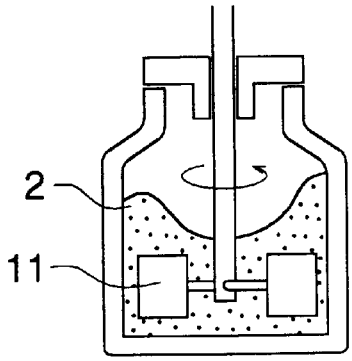

[3] FIG. 3 shows a method in which mechanical stress is applied to the carrier by rotating the stirring blades provided in a mixing container. In FIG. 3, numeral 11 are stirring blades.

Figure 4:
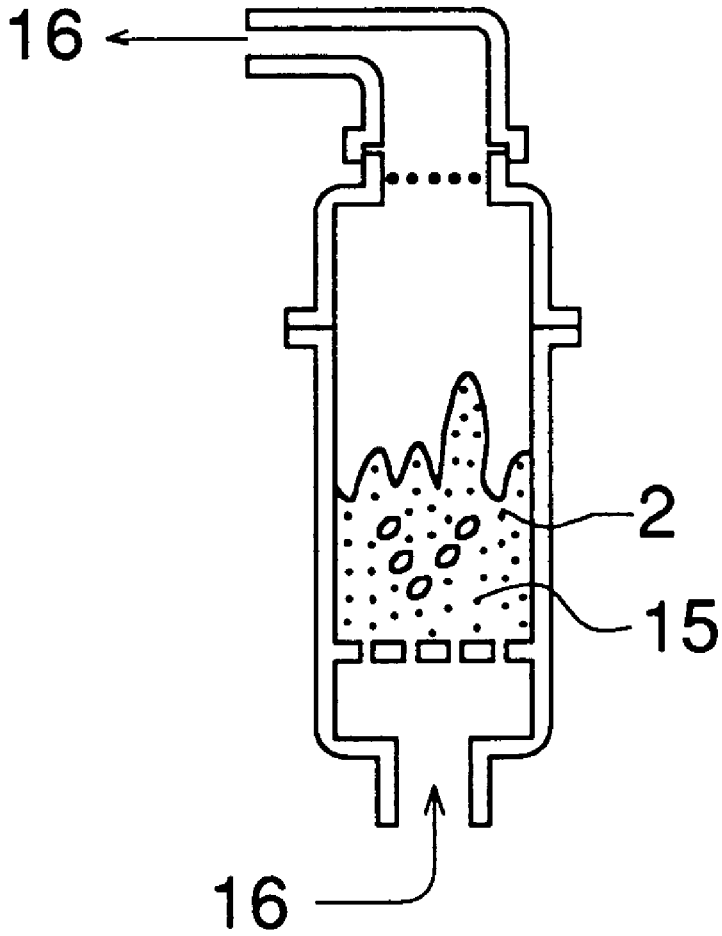
FIG. 4 is a sectional view showing a concept of a smoothing processing device, according to the present invention, in which carrier is fluidized by an air flow or liquid flow, and thereby mechanical stress is applied onto the carrier particles.

[4] FIG. 4 shows a method in which the carrier is flown by an air current or a liquid current, and carriers come into contact with each other so that mechanical stress is applied to the carriers. In FIG. 4, numeral 15 is a screen, and numeral 16 is an air current (or liquid current).

Figure 5:
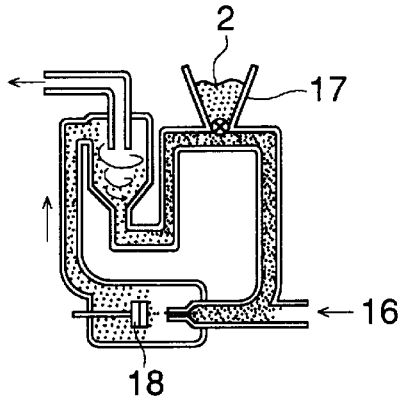
FIGS. 5(*a*), 5(*b*), 5(*c*) and 5(*d*) are view showing a concept of a smoothing processing device, according to the present invention, in which carrier particles collide with an inner wall or a collision plate of the device, and thereby mechanical stress is applied onto the carrier particles.
Figure 5:
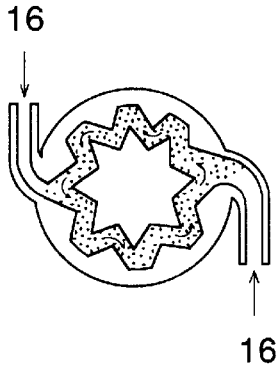
Figure 5:
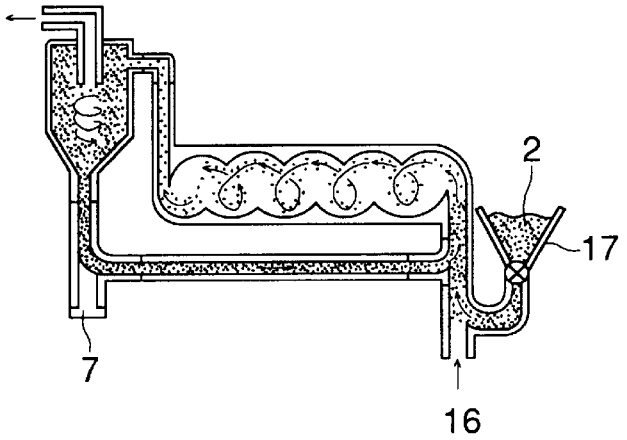
Figure 5:
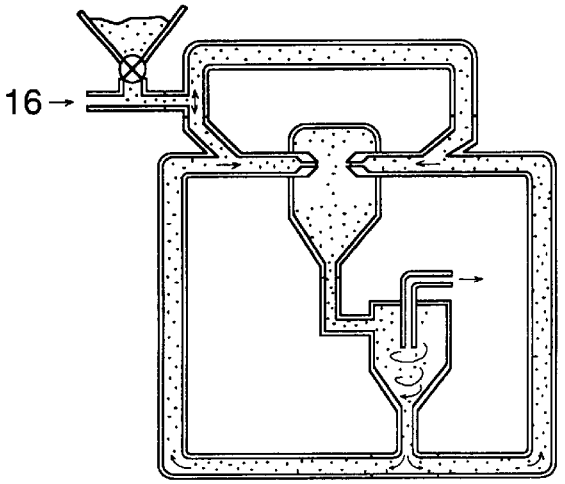

[5] FIG. 5 shows a method in which carrier passes or circulates in the device due to an air current or a liquid current, and the carrier comes into contact with an inner wall of the device or a collision plate provided in the device, or other carrier particles, so that the mechanical stress is applied to the carrier. In FIG. 5, numeral 16 is an air current (or liquid current), numeral 17 are hoppers and numeral 18 is a collision plate.

Figure 6:
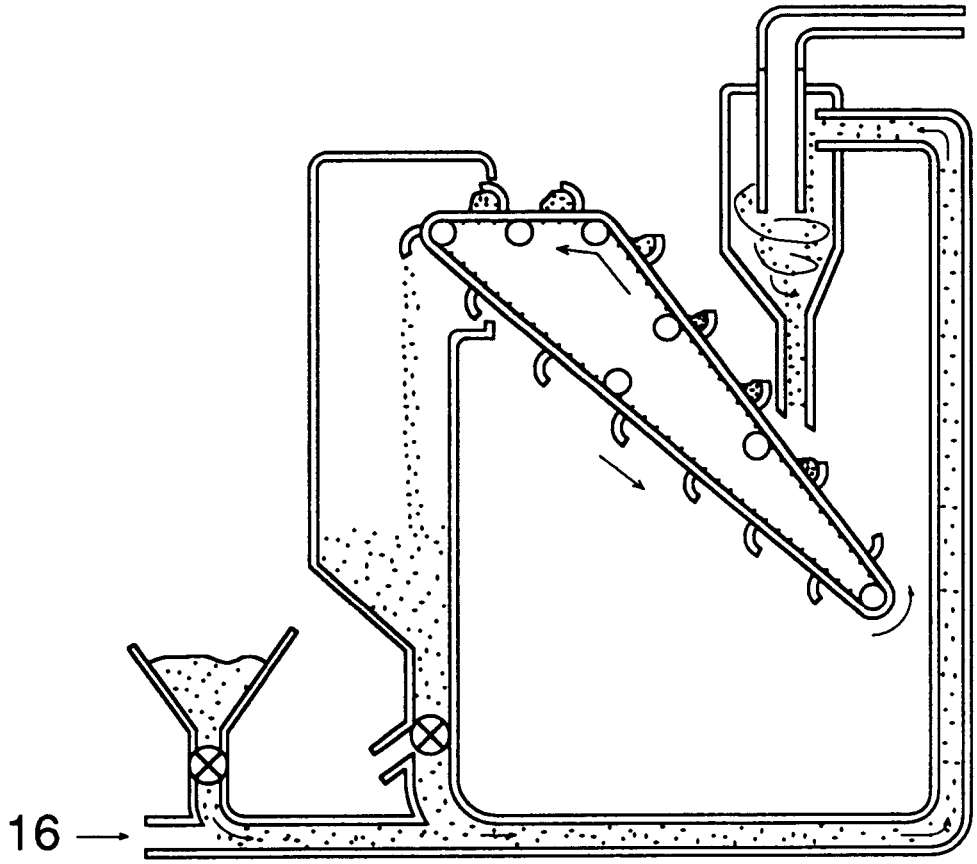
FIG. 6 is a view showing a concept of a smoothing processing device, according to the present invention, in which carrier particles fall freely, and thereby mechanical stress is applied onto the carrier particles.

[6] FIG. 6 shows a method in which the carrier falls freely in the device and the carrier comes into contact with an inner wall of the device or a collision plate provided in the device, so that mechanical stress is applied to the carrier.

In processing, when heating of the device itself, and a flowing gas or liquid are simultaneously conducted if necessary, the mechanical stress apply processing to the surface can be completed in a short time. In this case, when temperature of the carrier by heating is adjusted within the range of the melting point of the coating resin ±50° C., excellent results can be attained.

The most preferable of the devices in the above-described methods, is a stirring type mixing device in which stirring blades are rotated at high speed, because an appropriate mechanical strength can be easily applied to the carrier.

In the item (1), when the mechanical stress is applied to the carrier surface in the above-described method, it is preferable that the carrier sphericity $\alpha$, which is an index for applying the stress, is 1.0 through 16.0, and it is more preferable that it is 1.0 through 13.0.

The sphericity $\alpha$ of the resin coating carrier is found by the following equation.

$$\text{Sphericity } \alpha = (\text{the actual specific suface value})/(\text{a theoretical specific surface value}) = (SB)/(6/(D\cdot\rho))$$

Wherein,

SB: BET value [$m^2/g$]

D: weight average particle diameter [$\mu$m]

$\rho$: true density [$g/cm^3$]

wherein BET value SB means the specific surface measured by an $N_2$ gas adsorption method.

In the present invention, the value, measured by FLOWSORB 2300 (Micro Meritex) under the following conditions, is used.

Measuring method: one-point specific surface method

Gas supply: $N_2$ 30%/He 70% mixed gas

Gas pressure: about 1 kgf/cm$^2$

Gas flow amount: about 20 cm$^3$/min

Gas pass: SHORT PATH

Refrigerant: liquid nitrogen

Degasification temperature: 25° C. (room temperature)

The weight average particle diameter D is a value measured by a laser diffraction method. In the present invention, the $D_{50}$ value, measured by HELOS SYSTEM (Sympatec) under the following conditions, is used as the weight average particle diameter.

Measuring method: SUSPENSION CELL

Focal length: 100 mm

Medium solution: water+surface active agent

Ultrasonic wave application time: 20 sec

Static time: 10 sec

Measuring time: 15 sec

The true density ρ is a value found by a pressure comparison method by a gas phase substitution method. In the present invention, the value, measured by a high accuracy automatic volumeter VM-100 (Estec) under the following conditions, is used.

Carrier gas: He

Supply pressure: about 1.0 kgf/cm$^2$

Measuring environment: 25° C./50 %RH

Number of measurements: 4 times (average value is calculated)

When the sphericity of the carrier obtained by the surface polymer coating method is regulated within an appropriate range, the fluidity of the carrier, which is a problem in the surface polymerization coating method, is enhanced. Thereby, the conveying property of the developer can be stabilized for a long period of time.

As a production method of toner which can be used in the present invention, any commonly known method can be used. Specifically, after toner composing materials are mixed, and fusion-kneaded, cooling, pulverizing and classifying are carried out. Further, emulsion polymerization, or suspension polymerization method can also be used as a polymerization method for obtaining the toner.

According to the present invention, the technological problems of the carrier having the polyolefin resin coating layer on the magnetic particle by the surface polymerization coating method, are solved by adopting $Fe_2O_3$ and the magnetic particle having an oxide of any of elements selected from {Li, Be, Na, Mg, K, Ca, Rb}. As effects in which the magnetic particle has an oxide of any of these elements selected from {Li, Be, Na, Mg, K, Ca, Rb}, the following effects are cited.

1) The specific gravity can be reduced to less than that of heavy metals such as copper, zinc, etc., which are included in the conventional magnetic particles, so that stress in the developing unit can be reduced. Therefore, a stable image can be obtained without varying the charging property of the carrier.

2) The diameter of the sintered primary particles of the surface of magnetic substance, (hereinafter, sintered primary particles are referred to as "grain"), can be controlled relatively uniformly and minutely. Therefore, polymerization of polyolefin resin on the surface of the magnetic substances advances easily and uniformly, and exposure of the magnetic particle can be avoided. Accordingly, the occurrence of toner-spent can be prevented.

3) Inhibition to polymerization of polyolefin resin on the surface of the magnetic particle scarcely occurs, and thereby adherence of the magnetic particle to the polyolefin resin on the interface between the two materials is strong. Accordingly, even when this magnetic particle is used in any developing process, the polyolefin coating layer is not peeled off.

The oxide of any of elements selected from {Li, Be, Na, mg, K, Ca, Rb} included in the magnetic particle of the present invention, (hereinafter, it is referred to as "metal oxide of the present invention"), has a density of not more than 2.0 g/cm$^2$, and when a solid solution is formed with it and $Fe_2O_3$, appropriate magnetic characteristics and a low specific gravity can be attained. As the specific gravity of the magnetic particles of the present invention, it is preferable that the specific gravity is not more than 4.9 g/cm$^3$, and more preferably, not more than 4.7 g/cm$^3$. In a preferred form of the Invention, the magnetic particles have pores on the surfaces thereof; these pores have a total volume of 0.015 to 0.150 cc/g, based on the magnetic particles. The specific gravity can be measured using a highly accurate automatic volumeter (for example, a VM-100 made by Estec Co.) by a vapor phase substitution method, for example.

It is not always necessary that the metal oxide of the present invention initially be an oxide, at the time of material, but it may become an oxide after sintering. As the material, the following are listed: oxygen acid salts such as calcium carbonate, magnesium carbonate, lithium carbonate, lithium sulfate, etc.; or minerals including light metals (lithium) as a primary component, such as halides, spodumenes, etc.

It is preferable that the content ratio of the metal oxide of the present invention in the carrier be 5 through 50 mol %, with respect to the entire amount of the carrier components, and more preferably, 10 through 45 mol %. When it is less than 5 mol %, there is a possibility that the desired low specific gravity can not be attained, or polymerization of the resin can not be uniformly and stably achieved. When it is more than 50 mol %, there is a possibility that magnetic characteristics, by which an electrostatic latent image formed on a photoreceptor is accurately developed, can not be attained.

In the metal oxide of the present invention, $Li_2O$, $Na_2O$, MgO, $K_2O$, CaO and $Rb_2O$ are preferable from the view point of environmental concern, and $Li_2O$ is preferable because of its easily attained low specific gravity, and its grain diameter is easily controlled.

In the present invention, it is preferable that phosphorus compounds such as yellow phosphorus, red phosphorus, white phosphorus, black phosphorus, violet phosphorus, metal phosphorous, phosphoric acid type compound, etc., are added to promote crystallization and uniform growth of grains of the magnetic particles. Thereby, uniform and fine grains can be easily obtained, and the strength of the carrier is increased, preventing deterioration of the carrier in the developing unit. As the amount of added phosphorus compounds, it is preferable that it be about 0.05 through 2 wt %, and more preferably, 0.1 through 1 wt %. When the addition amount is too excessive, there is a possibility that the polymerization of the polyolefin resin is inhibited.

Other than the above-described additives, the following may be added: sintering accelerator (rare earth compounds such as $V_2O_5$, $As_2O_3$, $Bi_2O_3$, $Sb_2O_3$, $PbO_2$, CuO, $B_2O_3$, $SiO_2$, CaO, Cs, Nb, etc., and metal compounds such as $Li_2CO_3$, $CuSO_4$, $CuCl_2$, $CaCO_3$, etc.); grain diameter control agents; or components to control the electrical resistance and charging amount of the carrier. In order to fully display the effects of the present invention, it is preferable that the overall amount of these included components is not more than 3 wt %.

The magnetic particles of the present invention have the structure into which numerous grains are sintered, and numerous pores are uniformly formed on the magnetic particle surface, and inside the magnetic particles themselves. Accordingly, excellent properties can be provided to the magnetic particles. That is, when numerous fine and uniform holes are formed on the magnetic particle surface and inside the magnetic particle, a highly active catalyst, which is used when coating of the surface of the resin is carried out by polymerization, is carried and fixed not only on the magnetic particle surface but also inside the magnetic particle, the surface coating resin can be polymerized and grown from the inside of the magnetic particle. Accordingly, the adherence area between the magnetic particle and the coating resin is not only increased, but also the coating resin exists densely deep inside the magnetic particle, so that peeling of the coating resin is prevented. Polymerization of the polyolefin starts from "the pores at the boundary between grains" by which the catalyst is carried. Therefore, the fine grain diameter is effective in eliminating the exposed portion of the magnetic particles. When the exposed portions of the magnetic particles, in which the surface energy is higher than that of the polyolefin, are eliminated, the toner-spent to the portions is less. Thereby, the developer can maintain stable charging property for a long period of time, so that a high quality image can be provided.

In order to form appropriate pores on the magnetic particle surface and inside the magnetic particle, it is important to control the particle diameter of the grain, by which the magnetic particle is structured, and its sintering density. Specifically, it is preferable that the average particle diameter of the grains, by which the magnetic particle is structured, is within the range of 1/100 through 1/10 of the average particle diameter of the magnetic particles, and more preferably, it is within the range of 1/75 through 1/20. When the average particle diameter of grains is smaller than 1/100 of the magnetic particles, the mechanical strength of the magnetic particle is insufficient, and there is a possibility that the carrier is destroyed during use in the developing unit, resulting in undesirable images. When the average particle diameter of grains is larger than 1/10 of the magnetic particles, the desired pores do not exist on the surface of the magnetic particle nor inside the magnetic particle, resulting in a decrease of the adherence force to the coating resin. In this connection, the average particle diameters can be measured using an SEM photograph on which the magnetic particles are photographed.

Since the apparent density of the magnetic particle reflects the sintering density of the grain, the sintering density of the grain can be estimated by using the apparent density of the magnetic particle as a parameter. In the present invention, when the apparent density of the magnetic particle is approximately 1.60 through 2.60 g/cm$^3$, and more preferably, 1.8 through 2.40 g/cm$^3$, desirable results are attained. When the apparent density is less than 1.60 g/cm$^3$, the sintering strength between grains, that is, the mechanical strength of the magnetic particle is insufficient. Thereby, there is a possibility that the carrier is destroyed during use in the developing unit, resulting in undesirable images. When the apparent density is greater than 2.60 g/cm$^3$, the desired pores do not exist inside the magnetic particle, resulting in a decrease of the adherence force to the coating resin. In this connection, the apparent density of the magnetic particle used in this specification is measured by the method according to JIS Z-2504.

The magnetic particles are manufactured by a sintering method, atomizing method, etc., and more than 2 types of fine powders are mixed and sintered if necessary.

The carrier of the present invention is obtained when the polyolefin resin is coated on the surface of the magnetic particles, obtained by the above-described methods, by the surface polymerization coating method.

In the present invention, the polyolefin resin means a polymer of olefin monomers, specifically, a polymer of olefin monomer such as ethylene, propylene, butene, butadiene, etc.

As the method by which the polyolefin resin is coated on the surface of the magnetic particle by a surface polymerization coating method, the following method is listed. For example, a method disclosed in Japanese Patent Publication Open to Public Inspection No. 106808/1985, and specifically, a method in which the magnetic particle of the present invention is previously dispersed and impregnated in a solution in which a catalyst is dissolved, olefin monomer is continuously supplied into this solution, and polymerized, or the like, are listed.

Further, when necessary, charge control agents and resistance control agents can be added into the carrier coating layer. Specifically, when these additives exist under the condition of fine particles in the reaction tank so that these additives do not inhibit the polymerization, these additives are added into the carrier coating layer at polymerization, and finally, these additives are dispersed into the coating layer so as to obtain the carrier.

As the charge control agents, the following can be used: silica, titan, alumina, tin oxide, silicon carbide, barium sulfate, magnesium sulfate, or the like. As resistance control agents, the following can, for example, be used, carbon black, acetylene black, magnetite fine particle, ferrite fine particle, or metal fine particles of aluminium, copper, nickel, iron, etc.

The coating amount of the polyolefin resin onto the magnetic particle is approximately 2.0 through 12.0 wt %, and is more preferably, 3.0 through 8.0 wt %. When the coating amount is less than 2.0 wt %, the magnetic particle surface tends to be exposed, and there is a possibility that insufficient effects of the stress absorption are attained. When the coating amount is more than 12.0 wt %, fluidity of the carrier is lowered, resulting in an undesired image due to poor conveying property.

In the present invention, in order to attain an excellent developing property, the intensity of magnetization ($\sigma_1$k) of carrier in 1000 oersted is approximately 35 through 100 emu/g, and preferably 45 through 80 emu/g. When the intensity is not more than 35 emu/g, there is a possibility that carrier adherence occurs because the magnetic constraining force to the developing sleeve is small, or a highly dense and excellent image can not be obtained because the dimension of the magnetic brush is decreased. When the intensity is not less than 100 emu/g, there is a possibility that the magnetic brush becomes rigid, and so-called scavenging phenomenon, by which toner is scraped off after developing the latent image, occurs, so that a line perpendicular to the developing direction tends to be erased.

It is preferable that the coercive force of the carrier be not more than 100 oersted, and it is more preferable that it is not more than 50 oersted. When it is more than 100 oersted, flocculation of the carrier itself becomes strong. Thereby, there is a possibility that the mixing property of the carrier with the toner is decreased, or the carrier adheres firmly onto the developing sleeve provided with the fixed magnet, so that the conveying property of the developer is largely lowered, resulting in a nonuniform image. Magnetic characteristics can be measured, for example, by a DC magnetic characteristic automatic recorder (made by Yokogawa Electric Co.; type 3257-35, etc.) which is on the market.

It is preferable that the electric resistance of the carrier particle is $1\times10^{7}$ through $1\times10^{13}$ Ω cm. When the resistance is not larger than 1×107, carrier adherence tends to occur due to injection of the electrical charge from the photoreceptor surface onto the carrier particle. When it is not smaller than $1\times10^{13}$, there is a possibility that a high density image is scarcely obtained. Here, the electrical resistance means the volume resistance, which is measured by the following method.

One g of carrier is filled into an insulating cylindrical container having a sectional area of 1.0 $cm^2$, and the container is tapped 100 times. After the height of the sample carrier is measured after applying a 500 g weight onto the sample carrier, an electrical field of DC 100V is applied on the container, and a current value is measured. Volume resistance [Ω cm] is found by the following relationship: (100 [V]×the sectional area [$cm^2$])/(the current value [A]× the height of the sample [cm])

It is preferable that the average particle diameter of the carrier particle be 20 through 300 μm, and it is more preferably that it is 30 through 150 μm. When the average particle diameter is not more than 20 μm, carrier adherence onto the photoreceptor tends to occur. When it is not less than 300 μm, there is a possibility that stirring can not be uniformly carried out in the reaction tank at the time of the surface polymerization coating, so that it is difficult to uniformly form the coating layer. The average particle diameter, here, means the average particle diameter according to volume reference, measured by a laser beam diffraction type particle diameter distribution measuring device, provided with a wet distributing device, (for example, made by Sympatec Co.; HELOS).

There are no limitations for toner, used in combination with the carrier of the present invention, and any toner can be used which is normally produced, and composed of binding resins and coloring agents as a primary component, and to which separation agents, charge control agents, magnetic substances, fluidity agents, etc., are added, if necessary.

The surface polymerization coating method employed in the present invention is disclosed in detail in Japanese Patent Publication Open to Public Inspection No. 106808/1985.

More concretely, the above-mentioned method is comprising steps of:

preparing a hydrocarbon type solvent-soluble high active catalyst composition containing a titanium compound or a zirconium compound, mixing a magnetic particle, an organic aluminium compound and the catalyst composition, and adding an olefin monomer to the mixtures, so that a polymerization product of the olefin monomer is coated onto a surface of the magnetic particle.

As the olefin monomer, ethylene, propylene, butene, hexene, methylpentene, decene or octadecene are preferably employed, and further, two kinds or more olefin monomer may be employed together. However, ethylene is particularly preferable.

EXAMPLES

The present invention will be described in detail in the following examples. However, the embodiment of the present invention is not limited to these examples.

Example 1

[Production of carrier]

Carriers $A_1$1, $A_1$2, and $A_1$3 are manufactured using the following method.

Production example 1-1 of carrier 100 ml of anhydrous n-heptane, and 10.0 g (17 mmol) of magnesium stearate, which is previously pressure-reduced (2 mmHg) and dried at 120° C., are supplied into a 500 ml flask, substituted by argon, at room temperature, and formed into a slurry. While stirring, 0.33 g (1.7 mmol) of titanium tetrachloride is added to the mixture, and then the temperature is raised. This mixture is caused to react for 2 hours in the reflux, and a viscous and transparent solution, including titanium-contained catalyst component, is obtained.

After that, 500 ml of anhydrous n-hexane, and 500 g of magnetite particles, reduced pressure which is dried previously under the condition at 200° C. for 3 hours, are supplied into an autoclave, a constant volume of 1 liter is substituted by argon at room temperature, and mixed. Then the temperature is raised to 40° C., and 0.02 mmol of titanium-contained polymerization catalyst component is added to the mixture as the titanium element. This is then heat-processed for about 1 hour, and a slurry mixture is obtained.

Next, 0.50 g of carbon black (KETCHEN BLACK EC: Lion Aquzo), which has been pressure-reduced for 2 hours and dried at 200° C., is added to the mixture and stirred. Following this, 2.0 mmol of triethyl aluminium, and 2.0 mmol of diethyl aluminium chloride are added to the mixture, and the temperature is raised to 90° C. At this time, the pressure in this system is 1.5 kg/$cm^2$G. Next, hydrogen gas is supplied and the pressure is increased to 3.5 kg/$cm^2$G, and polymerization is carried out for 20 minutes while ethylene is continuously supplied so that the pressure of the entire system is maintained at 8.5 kg/$cm^2$G. Thus, carbon black-included polyethylene coating magnetite particles are obtained.

After that, flocculates are removed by passing the above-product through a 106 μm sieve, and polyethylene coating carrier All is obtained. The sphericity a of this carrier All is 24.5.

Production example 1-2 of carrier

Polyethylene coating carrier $A_1$2 is obtained in the same manner as in production example 1-1, except that the ethylene polymerization time is changed to 30 minutes. The sphericity α of the carrier $A_1$2 is 28.6.

Production example 1-3 of carrier

Polyethylene coating carrier $A_1$3 is obtained in the same manner as in the production example 1-1, except that ethylene polymerization time is changed to 40 minutes. The sphericity α of this carrier is 29.8.

Low density polyethylene (HI-WAX 220P: Mitsui Oil Chemical Co.) is heat-dissolved in toluene , and this solution is used as a coating solution. Polyethylene resin coating carrier $B_1$1 is obtained when the surface of the magnetite core is coated by Spila-coater (Okada Seiko Co.).

These carriers are shown in Table 1.

TABLE 1

| Core particle | | | Coated carrier | | | |
|---|---|---|---|---|---|---|
| | | | | | Weight | |
| Material | Pore volume [$cm^3$/g] | Pore diameter [μm] | Carrier No. | Coating ratio [wt %] | average diameter [μm] | Sphericity α |
| Magnetite | 0.042 | 1.2 | A1-1 | 1.8 | 68 | 24.5 |
| Magnetite | 0.098 | 2.6 | A1-2 | 3.5 | 54 | 28.6 |
| Magnetite | 0.025 | 2.0 | A1-3 | 5.2 | 82 | 29.8 |

TABLE 1-continued

| Core particle | | | Coated carrier | | | |
|---|---|---|---|---|---|---|
| | | | | | Weight | |
| Material | Pore volume [$cm^3/g$] | Pore diameter [$\mu m$] | Carrier No. | Coating ratio [wt %] | average diameter [$\mu m$] | Sphericity $\alpha$ |
| Magnetite | 0.145 | 3.2 | B1-1 | 2.7 | 104 | 27.2 |

After that, these polyethylene resin coated carriers $A_1 1$ through $A_1 3$ and $B_1 1$ are respectively supplied into a Henshel mixer, and mixed and stirred for one hour under at a stirring blade peripheral speed of 20 m/s, heated at 90° C., and mechanical stress is thus applied onto the surface of each carrier. Thus, carriers $A_1 4$ through $A_1 6$ and $B_1 2$ are obtained. The carriers $A_1 4$ through $A_1 6$ and $B_1 2$ are listed in Table 2.

TABLE 2

| | Coated carrier after surface smoothing | | | |
|---|---|---|---|---|
| Before smoothing | Carrier No. | Coating ratio [wt %] | Weight average diameter [$\mu m$] | Sphericity $\alpha$ |
| A1-1 | A1-4 | 1.8 | 68 | 10.6 |
| A1-2 | A1-5 | 3.5 | 54 | 15.4 |
| A1-3 | A1-6 | 5.2 | 82 | 7.6 |
| B1-1 | B1-2 | 2.7 | 104 | 15.8 |

[Production of toner and developer]

Toner and developer used in the present invention are produced by the following method.

Low molecular weight polypropyrene (BISCOL 660P: made by Sanyo Chemical Co.) of 2 parts by weight as separating agents, and carbon black (BLACK PEARL L: made by Cabot Co.) of 10 parts by weight as coloring agents are mixed with styrene/acrylic resin of 100 parts by weight, and these are fusion-kneaded by a 2-shaft kneader.

Then, powdering and air separation are carried out through a cooling process, and a crushing process, and colored particles having weight average particle diameter of 7.5 $\mu m$, are obtained. After that, hydrophobic silica fine particles (HDK-H2050EP: made by Wacker Chemical Co.) of 1.0 parts by weight are added to the colored particles as fluidity agents and mixed together. Thus, positively charging toners, used in the present invention, are obtained.

Then, 26 g of this toner and 500 g of carrier are charged into a V-type mixer, mixed for 20 minutes, and a two-component type developer is obtained.

[Performance evaluation]

The above-described developer is charged into a commercial copier Konica U-BIX4155 (by Konica Corporation), and the actual 100,000th copied image sheet is evaluated under 20° C. and 50% RH. The evaluated items and evaluation methods will be described below.

(Image density)

A solid image of the original document density 1.30 is copied and its relative reflection density compared to a white sheet is measured. A Macbeth Densitometer RD-917 (by Macbeth Co.) is used for the image density measurement, and the image density of not less than 1.30 is judged to be good. The evaluation is conducted two times on the first and final copied sheets.

(Conveying amount of developer)

A developing unit is removed from a copier, and the weight of developer per unit area on the developing sleeve is measured as the conveying amount of the developer. This measurement is conducted two times on the first final copied sheets, and the smaller the weight difference between the two sheets is, the better the developer is judged to be.

An example of the present invention, the performance of the carrier, used in the example, and the results of actual copy evaluation are shown in Table 3.

TABLE 3

| | Coated carrier | Relative image density | | Conveying amount of developer [$mg/cm^2$] | |
|---|---|---|---|---|---|
| Example | No. | Initial | $10^5$th | Initial | $10^5$th |
| Inventive 1-1 | A1-4 | 1.35 | 1.35 | 62 | 62 |
| Inventive 1-2 | A1-5 | 1.35 | 1.34 | 62 | 61 |
| Inventive 1-3 | A1-6 | 1.34 | 1.35 | 62 | 62 |
| Comparative 1-1 | A1-1 | 1.36 | 1.28 | 56 | 48 |
| Comparative 1-2 | A1-2 | 1.34 | 1.20 | 54 | 50 |
| Comparative 1-3 | A1-3 | 1.30 | 1.16 | 50 | 42 |
| Comparative 1-4 | B1-2 | 1.40 | 1.10 | 60 | 52 |

As Table 3 shows, characteristics of any of Inventive examples 1-1 through 1-3 are good. On the contrasy, there are distinct disadvantages in evaluated characteristics of any of Comparative examples 1-1 through 1-4.

Example 2

Production example 2-1 of carrier 100 ml of anhydrous n-heptane, and 10.0 g (17 mmol) of magnesium stearate, which was previously reduced pressure (2 mmHg) and dried at 120° C., are supplied into a 500 ml of flask, substituted by argon at room temperature, and made into slurry. While stirring, 0.33 g (1.7 mmol) of titanium tetrachloride is added to the mixture, and then temperature is raised. This mixture is allowed to react for 2 hours in the reflux, and a viscous and transparent solution, including the titanium-containing catalyst component, is obtained.

After that, 500 ml anhydrous n-hexane, and 500 g magnetite particle a (the average particle diameter is 55 $\mu m$; the sphericity $\alpha$: 14.7) which was dried previously under a reduced pressure condition at 200° C. for 3 hours, are supplied into an autoclave, the constant volume of 1 liter is substituted by argon at room temperature, and mixed. Then the temperature is raised to 40° C., and 0.02 mmol of titanium-contained polymerization catalyst component is added to the mixture as the titanium element. Then these are heat-processed for about 1 hour, and a slurry mixture is obtained.

Next, 0.50 g of carbon black (KETCHEN BLACK EC: Lion Aquzo), which was dried previously under a reduced pressure condition at 200° C. for 2 hours, is added to the mixture and stirred. Then, 2.0 mmol of triethyl aluminium, and 2.0 mmol of diethyl aluminium chloride are added to the mixture, and the temperature is raised to 90° C. At this time, the pressure in this system is 1.5 $kg/cm^2G$. Next, hydrogen gas is supplied and the pressure is increased to 2.5 $kg/cm^2G$, and polymerization is then carried out for 20 minutes while ethylene is continuously supplied so that the entire pressure of the system is maintained at 9.0 $kg/cm^2G$. Thus, carbon black-contained polyethylene coating magnetite particles are obtained.

After that, flocculates are removed by passing the above-product through a 106 μm sieve, and polyethylene coating carrier $A_2$1 is obtained. The sphericity α of this carrier $A_2$1 is 31.6.

Production example 2-2 of carrier

Polyethylene coating carrier $A_2$2 is prepared in the same manner as in Example 2-1, except that the ethylene polymerization time is changed to 30 minutes. The sphericity α of the carrier $A_2$2 is 34.5.

Production example 2-3 of carrier

Polyethylene coating carrier $A_2$3 is prepared in the same manner as in the Production example 2-1, except that ethylene polymerization time is changed to 40 minutes. The sphericity α of this carrier is 35.0.

Production example 2-4 of carrier

Polyethylene coating carrier $A_2$4 is prepared in the same manner as in Production example 2-2, except that magnetite particle a is replaced with magnetite particle b (the average particle size is 60 μm. The sphericity α of the carrier $A_2$4 is 34.1.

These polyethylene resin coating carriers $A_2$1 through $A_2$4, prepared by Production examples 2-1 through 2-4 of carrier, are respectively supplied into a Henshel mixer, and mixed and stirred for 40 minutes under the condition that the peripheral speed of the mixing blade is 20 m/s, heated at 80° C., so that the surface of each carrier is smoothed. Thus, carriers $A_2$5 through $A_2$8 are obtained, surfaces of which are smoothed. The sphericity a of carriers, the surface of which is smoothed, is shown in Table 4(2).

Comparative Examples 2-1 through 2-4

The polyethylene resin coating carriers $A_2$1 through $A_2$4, prepared in Production examples 2-1 through 2-4 of carriers, are used, without any additional processing.

Comparative Example 2-5

Low density polyethylene (HI-WAX 220P: Mitsui Oil Chemical Co.) is heat-dissolved in toluene, and this solution is used as a coating solution. Polyethylene resin coating carrier $B_2$1 is obtained when the surface of the magnetite particle a is coated by a Spila-Coater (Okada Seiko Co.). The sphericity α of polyethylene resin coating carrier $B_2$1 is 24.8.

These resin coating carriers are shown in Table 4(1), 4(2).

TABLE 4(1)

| Core particle | | Coated carrier | | | |
|---|---|---|---|---|---|
| Material | Total pore volume [$cm^3$/g] | Carrier No. | Coating ratio [wt %] | Weight average diameter [μm] | Sphericity α |
| Manetite a | 0.077 | A2-1 | 3.2 | 56 | 31.6 |
| Manetite a | 0.077 | A2-2 | 4.0 | 58 | 34.5 |
| Manetite a | 0.077 | A2-3 | 5.5 | 60 | 35.0 |
| Manetite b | 0.052 | A2-4 | 4.5 | 64 | 34.1 |
| Manetite a | 0.077 | B2-1 | 2.6 | 56 | 24.8 |

TABLE 4(2)

| Coated carrier after surface smoothing | | | | |
|---|---|---|---|---|
| Before smoothing | Carrier No. | Coating ratio [wt %] | Weight average diameter [μm] | Sphericity α |
| A2-1 | A2-5 | 3.2 | 56 | 16.6 |
| A2-2 | A2-6 | 4.0 | 58 | 18.4 |
| A2-3 | A2-7 | 5.5 | 60 | 20.3 |
| A2-4 | A2-8 | 4.5 | 64 | 16.8 |

[Production of toner and developer]

Toner and developer, used in the present invention, are produced in the same manner as in Example 1.

[Performance evaluation]

The above-described developer is loaded in a commercial copier Konica U-BIX4155 (by Konica Corporation), and actual copied images are evaluated when 100,000 sheets are continuously copied under the condition of 20° C. and 50% RH. Evaluated items and the evaluation method will be described below.

(Image density)

A solid image of the original document density of 1.30 is copied and its relative reflection density against a white sheet is measured. A Macbeth densitometer RD-917 (made by Macbeth Co.) is used for the density measurement, and an image density of not less than 1.30 is judged to be good. The evaluation is conducted twice on the first and final copied sheets.

(Fog density)

The fog density is correlated with the spread of the toner charging amount distribution. As an evaluation, a white original document sheet is newly copied after the completion of another copy, and the relative reflection density of the outputted image against the white sheet is measured. The Macbeth densitometer is used for the density measurement, and an fog density of not more than 0.005 is judged to be good.

Examples of the present invention, and the performance of the carrier, used in the example, and the results of actual copy evaluation are shown in Table 5.

TABLE 5

| Example | Coated carrier | Relative image density | | Relative fog density |
|---|---|---|---|---|
| | | Initial | $10^5$th | |
| Inventive 2-1 | A2-5 | 1.36 | 1.35 | 0.000 |
| Inventive 2-2 | A2-6 | 1.35 | 1.35 | 0.001 |
| Inventive 2-3 | A2-7 | 1.35 | 1.36 | 0.001 |
| Inventive 2-4 | A2-8 | 1.35 | 1.36 | 0.000 |
| Comparative 2-1 | A2-1 | 1.31 | 1.22 | 0.008 |
| Comparative 2-2 | A2-2 | 1.32 | 1.25 | 0.009 |
| Comparative 2-3 | A2-3 | 1.30 | 1.21 | 0.015 |
| Comparative 2-4 | A2-4 | 1.31 | 1.05 | 0.019 |
| Comparative 2-5 | B2-1 | 1.26 | 1.02 | 0.030 |

As can be seen from Inventive Examples 2-1 through 2-4 of the present invention, there is no problem in any of characteristics of image density, and fogging. In contrast to this, there are some problems in characteristics of Comparative Example 2-1 through 2-5, which are not preferable for commercial use.

Example 3

{Production of magnetic particle}

Raw materials are weighed, and each component has the composition (mole ratio) as shown in Table 6. These components are mixed in a ball mill, and then the mixture is calcined and powdered. It is then added with polyvinyl alcohol as a binding agent, and are granulated using a spray dryer. After that, the grains are baked, and magnetic particles C1 through C4 are obtained. In this connection, the baking conditions are set to optimum conditions under which a desired grain diameter and specific gravity can be attained. The average particle diameter of the magnetic particles and grains are found by measuring 100 individual magnetic particles and grains using an SEM photograph.

TABLE 6

| Magnetic particle | Composition of ferrite (mol %) Light metal oxide | $Fe_2O_3$ | Additives (wt %) Red phosphorus | Others | Specific gravity ($g/cm^3$) | Average diameter of grain ($\mu m$) | Apparent specific gravity ($g/cm^3$) | Average particle size ($\mu m$) |
|---|---|---|---|---|---|---|---|---|
| C1 | $Li_2O$ 15% | 85% | 1.0 | None | 4.4 | 1.0 | 2.10 | 52 |
| C2 | $Li_2O$ 30% | 70% | 0.1 | $Bi_2O_3$ 1.0% | 4.1 | 2.0 | 1.94 | 50 |
| C3 | CaO 20% | 80% | 0.3 | None | 4.6 | 1.6 | 2.34 | 71 |
| C4 | MgO 35% | 65% | 0.1 | $CaCO_3$ 2.0% | 4.2 | 1.3 | 2.28 | 84 |
| C5 | $Li_2O$ 15%, MgO 10% | 75% | 0.2 | None | 4.3 | 2.2 | 2.19 | 63 |
| C6 | CuO 20%, ZnO 10% | 70% | 0.2 | None | 5.3 | 6.8 | 2.74 | 51 |
| C7 | $K_2O$ 15% | 85% | 1.0 | None | 4.5 | 1.0 | 2.20 | 52 |
| C8 | $Rb_2O$ 15% | 85% | 0.5 | None | 4.5 | 1.0 | 2.21 | 52 |
| C9 | $Na_2O$ 20% | 80% | 1.0 | None | 4.4 | 1.5 | 2.32 | 52 |

{Production of carrier}

The surface of the thus obtained magnetic particles is coated with polyethylene resin, referring to the surface polymerization coating method, disclosed in Japanese Patent Publication Open to Public Inspection No. 106808/1985. In this case, carbon black [made by Lion Aquzo Co.; KETCHEN BLACK ] of 2.5 wt % is added to and dispersed in the polyethylene resin. After that, this polyethylene resin coating carrier is supplied into a Henshel mixer, and mixed and stirred for one hour under the condition that the peripheral speed of the mixing blade is 20 m/s, heated at 90° C., and mechanical stress is applied onto the surface of carrier, and next, screening is carried out by a 106 $\mu m$ sieve. The carrier, obtained after passing the sieve, is referred to as CC1. The coated amount of the carrier was measured by a thermobalance, and found to be 3.8 wt %.

Except that the magnetic particle, added amount of carbon black, polyolefin resin and its coating amount are changed as shown in Table 7, carriers CC2 through CC4.

TABLE 7(1)

| Core particle: Core No. | Total pore volume [$cm^3/g$] | Coated carrier after surface smoothing: Carrier No. | Coating material | Coating ratio [wt %] | Added amount of C.B. [wt %] | Magnetization [emu/g] | Coercive force [Oe] |
|---|---|---|---|---|---|---|---|
| C1 | 0.048 | CC1 | PE | 3.8 | 2.5 | 65.0 | 5.0 |
| C2 | 0.032 | CC2 | PE | 4.4 | 2.2 | 60.0 | 4.1 |
| C3 | 0.096 | CC3 | PE | 3.5 | 2.1 | 55.0 | 3.2 |
| C4 | 0.024 | CC4 | PP | 5.0 | 1.4 | 52.6 | 0.0 |

TABLE 7(2)

| Carrier No. | Resistance [ohm · cm] | Weight average diameter [$\mu m$] | Sphericity α |
|---|---|---|---|
| CC1 | $3.2 \times 10^{10}$ | 55 | 11.4 |
| CC2 | $2.0 \times 10^{11}$ | 53 | 12.6 |

TABLE 7(2)-continued

| Carrier No. | Resistance [ohm · cm] | Weight average diameter [$\mu m$] | Sphericity α |
|---|---|---|---|
| CC3 | $1.3 \times 10^{9}$ | 75 | 15.5 |
| CC4 | $1.6 \times 10^{12}$ | 89 | 8.8 |

{Production of positive charging toner}

Low molecular weight polypropylene [made by Sanyo Kasei Co.; BISCOL 660P] of 4 weight parts as a separating agent, carbon black [Cabot Co.; BLACK PEARL L] of 12 weight parts, 4th grade ammonium salt [made by Orient Chemical co.; P-51] of 1 weight part, as coloring agents, are mixed into styrene/acrylic copolymer resin of 100 weight parts. The mixture is fused and kneaded by a 2-shaft kneader.

After that, the product of the above process is pulverized and pneumatically classified through cooling and rough powdering processes, so that colored particles of 7.5 $\mu m$ average particle diameter are obtained. Further, as a fluidity agent, fine particles of positive charging hydrophobic silica [made by Wacker Chemical Co.; HDK-H2050E] of 1.0 weight part are mixed into the colored particles, so that the toner used in this specification is obtained.

{Adjustment of positive charge developer}

500 g of carrier and 26 g of toner are supplied into a V-type mixer, and mixed for 20 minutes so that a 2-component developer is adjusted. This operation is carried out for each of carrier CC1 through CC4, and developers 1 to 4 are obtained.

526 g of each developer is loaded into a commercial copier [made by Konica Co.; U-Bix 4155], and actual copying operations are carried out as follows. $10^5$ sheets are actually copied under the conditions of 20° C. and 50% RH. A total of $10^5$ sheets are actually copied and each copied sheet is reviewed. Image density, Fog density, Conveying amount of developer and Toner-spent are evaluated by the following methods.

(Image density)

A solid image of a document density of 1.30 is copied, and the relative reflection density of the outputted image of the first copied sheet and that of the last copied sheet, with respect to a white sheet, is measured by a Macbeth densitometer (made by Macbeth Co.). When the image density is not less than 1.30, it is judged good.

(Fog density)

After above copying operations, a white document is copied, and the relative reflection density of its outputted image with respect to the white sheet is measured by the Macbeth densitometer (made by Macbeth CO.). When the density is not more than 0.005, it is judged good.

(Conveying amount of developer)

A developing unit is removed from a copying apparatus, and a developer held on a developing sleeve by a magnetic coercive force is collected with a magnet prepared separately. An area for developer collecting was limited to the area on the developing sleeve being closest to a photoreceptor, namely, the area in the vicinity of a developing area. In addition, for developer collecting, the developer located outside the area for developer collecting was removed with a scraper made of a non-magnetic material in advance, to avoid that the above-mentioned developer was also collected.

The developer collecting area this time was set to have 2 cm (a circumferential direction)×5 cm (an axial direction) on the developing sleeve.

Next, the developer collected with the magnet was weighed, and the weighed value was divided by an area (10 $cm^2$, in this case) of the collecting area to calculate the conveying amount of the developer.

A conveying amount of developer [$g/cm^2$]=

(A weight of a collected developer [g])/(A surface of a collected area [$cn^2$])

(Toner-spent)

After above copying operations, only carrier is separated from the developer using interface active agents. 3.0 g of separated carrier is dipped into 100 ml of methyl ethyl ketone, and any spent substance is dissolved, and transmissivity of its solution is measured by a spectrophotometer (type 330 Hitachi recording spectrophotometer) in a 500 nm wavelength of light beam, and this value is defined as the spent-amount (the degree of contamination of the carrier). When there is no spent substance, the value is 100%, and the more the spent-amount value increases, the more the value of transmissivity decreases.

The above results are shown in Table 8.

TABLE 8

| Example | Coated carrier | Relative image density [−] Initial | Relative image density [−] $10^5$th | Conveying amount of developer [$mg/cm^2$] Initial | Conveying amount of developer [$mg/cm^2$] $10^5$th | Toner spent [%] |
|---|---|---|---|---|---|---|
| Inventive 3-1 | CC1 | 1.36 | 1.35 | 60 | 61 | 98 |
| Inventive 3-2 | CC2 | 1.36 | 1.35 | 60 | 60 | 98 |
| Inventive 3-3 | CC3 | 1.35 | 1.36 | 60 | 60 | 97 |
| Inventive 3-4 | CC4 | 1.36 | 1.36 | 60 | 59 | 99 |

By the carrier of the present invention, no toner-spent occur on the carrier surface even after the actual copying operation, so that high quality output images can be continuously obtained.

As described above, the carrier of the present invention includes very small amounts of heavy metals, and thereby even when the developer is discarded after its usage, it contaminates the environment only negligibly.

Example 4

All samples are prepared in the same manner as in Example 3 as shown in Table 9, except that, in production of carrier, the polyethylene resin coating carrier is supplied into a Henshel mixer, and mixed and stirred for 30 minutes under the condition that the peripheral speed of the mixing blade is 20 m/s, heated at 90° C. Further, all samples are evaluated by the same method disclosed in Example 3, except for conveying amount of developer. Thus obtained results are shown in Table 10.

By the carrier of the present invention, no toner-spent occur on the carrier surface even after the actual copying operation, so that high quality output images can be continuously obtained.

As described above, the carrier of the present invention includes very small amounts of heavy metals, and thereby even when the developer is discarded after its usage, it contaminates the environment only negligibly.

TABLE 9(1)

| Core particle | | Coated carrier after surface smoothing | | | | | |
|---|---|---|---|---|---|---|---|
| Core No. | Total pore volume [$cm^3/g$] | Carrier No. | Coating material | Coating ratio [wt %] | Added amount of C.B. [wt %] | Magnetization [emu/g] | Coercive force [Oe] |
| C5 | 0.052 | CC5 | EB | 2.8 | 2.6 | 68.0 | 2.6 |
| C6 | 0.014 | CC6 | PE | 3.8 | 2.5 | 65.0 | 0.0 |
| C7 | 0.080 | CC7 | PE | 4.0 | 2.5 | 64.0 | 4.0 |
| C8 | 0.138 | CC8 | PE | 3.8 | 2.5 | 61.0 | 3.5 |
| C9 | 0.105 | CC9 | PE | 3.8 | 2.5 | 62.5 | 5.0 |

TABLE 9(2)

| Carrier No. | Resistance [ohm · cm] | Weight average diameter [μm] | Sphericity α[−] |
|---|---|---|---|
| CC5 | $5.6 \times 10^7$ | 65 | 23.8 |
| CC6 | $2.8 \times 10^{10}$ | 54 | 28.6 |
| CC7 | $2.1 \times 10^9$ | 55 | 20.0 |
| CC8 | $3.1 \times 10^{10}$ | 56 | 38.5 |
| CC9 | $3.5 \times 10^{10}$ | 55 | 30.2 |

TABLE 10

| Example | Coated carrier | Relative image density [−] Initial | Relative image density [−] $10^5$th | Relative fog density [−] | Toner spent [%] |
|---|---|---|---|---|---|
| Inventive 3-5 | CC5 | 1.36 | 1.35 | 0.001 | 99 |
| Inventive 3-6 | CC6 | 1.32 | 1.31 | 0.003 | 95 |
| Inventive 3-7 | CC7 | 1.35 | 1.36 | 0.002 | 98 |
| Inventive 3-8 | CC8 | 1.35 | 1.34 | 0.003 | 99 |
| Inventive 3-9 | CC9 | 1.36 | 1.34 | 0.002 | 98 |

What is claimed is:

1. A developer for developing an electrostatic latent image comprising a carrier and toner particles the carrier comprising magnetic particles coated with a polyolefin resin selected from the group consisting of polyethylene, polypropylene, polybutene, and polybutadiene by surface polymerization, said carrier having a sphericity a of 1.0 to 16.0;

wherein said magnetic particles consist essentially of a ferrite consisting of $FeO_3$ and at least one oxide of an element selected from the group consisting of Li, Be, Na, Mg, K, Ca, and Rb, said oxide being present in a concentration of 10 to 45 mol % based on said ferrite, and the magnetic particles having pores on surfaces thereof, a total volume of said pores being 0.015 to 0.150 cc/g, based on the magnetic particles.

2. The developer of claim 1, wherein said toner particles have a volume average particle size of 1 to 20 $\mu$m.

3. The developer of claim 1, wherein said toner particles have a volume average particle size of 4 to 15 $\mu$m.

4. The developer of claim 1 wherein said magnetic particles have a specific gravity of not more than 4.9 g/cm$^3$.

5. The developer of claim 4 wherein said oxide is selected from the group consisting of $Li_2O$, $Na_2O$, MgO, $K_2O$, CaO, and $Rb_2O$.

6. The developer of claim 5 wherein said oxide is $Li_2O$.

7. The developer of claim 1 wherein said carrier has an average particle diameter of 30 $\mu$m through 150 $\mu$m.

8. The developer of claim 1 wherein said magnetic particles further comprise a sintering accelerator.

9. The developer of claim 8 wherein said sintering accelerator is selected from the group consisting of $V_2O_5$, $As_2O_3$, $Bi_2O_3$, $Sb_2O_3$, $PbO_2$, CuO, $B_2O_3$, $SiO_2$, CaO, Cs, Nb, $Li_2CO_3$, $CUSO_4$, $CUCl_2$, and $CaCO_3$.

10. The developer of claim 1 wherein said magnetic particles comprise a compound selected from the group consisting of yellow phosphorus, red phosphorus, white phosphorus, black phosphorus, violet phosphorus, and phosphorus metal.

11. The developer of claim 1 wherein said polyolefin resin is polyethylene.

12. The developer of claim 1 wherein said oxide is an oxide of lithium.

13. A carrier for developing an electrostatic image comprising magnetic particles coated with a polyolefin resin selected from the group consisting of polyethylene, polypropylene, polybutene, and polybutadiene by surface polymerization, said carrier having a sphericity a of 1 to 16.0;

wherein the magnetic particles consist essentially of a ferrite consisting of $FeO_3$ and at least one oxide of an element selected from the group consisting of Li, Be, Na, Mg, K, Ca, and Rb, said oxide being present in a concentration of 10 to 45 mol % based on said ferrite, and the magnetic particles having pores on surfaces thereof, a total volume of said pores being 0.015 to 0.150 cc/g, based on the magnetic particles.

14. The carrier of claim 13 wherein said polyolefin resin is polyethylene.

* * * * *